United States Patent [19]

Kopperstad et al.

[11] 4,081,178

[45] Mar. 28, 1978

[54] APPARATUS FOR COLLECTION OF TAPPING GASES FROM ELECTRIC SMELTING FURNACES

[75] Inventors: Leif Kopperstad, Fauske; Halldor Opedal, Oslo, both of Norway

[73] Assignee: Elkem-Spigerverket A/S, Oslo, Norway

[21] Appl. No.: 761,529

[22] Filed: Jan. 24, 1977

[30] Foreign Application Priority Data

Feb. 2, 1976 Norway ..... 760323

[51] Int. Cl.[2] ..... C21C 5/52

[52] U.S. Cl. ..... 266/158; 266/143

[58] Field of Search ..... 13/1; 75/60; 122/7 A; 266/142, 143, 158

[56] References Cited

U.S. PATENT DOCUMENTS

| | | | |
|---|---|---|---|
| 3,913,898 | 10/1975 | Wolters | 13/1 |
| 3,938,788 | 2/1976 | Josten | 266/142 |

FOREIGN PATENT DOCUMENTS

| | | | |
|---|---|---|---|
| 306,992 | 12/1968 | Sweden | 13/1 |

*Primary Examiner*—Gerald A. Dost

*Attorney, Agent, or Firm*—Eyre, Mann, Lucas & Just

[57] ABSTRACT

Apparatus for collection of tapping gases to prevent worker exposure to them is disclosed.

The apparatus comprises a plurality of screens in combination with an opening in the floor positioned so that tapping gases are removed by the smoke hood without the need for separate tapping gas removal apparatus.

5 Claims, 2 Drawing Figures

FIG. 1
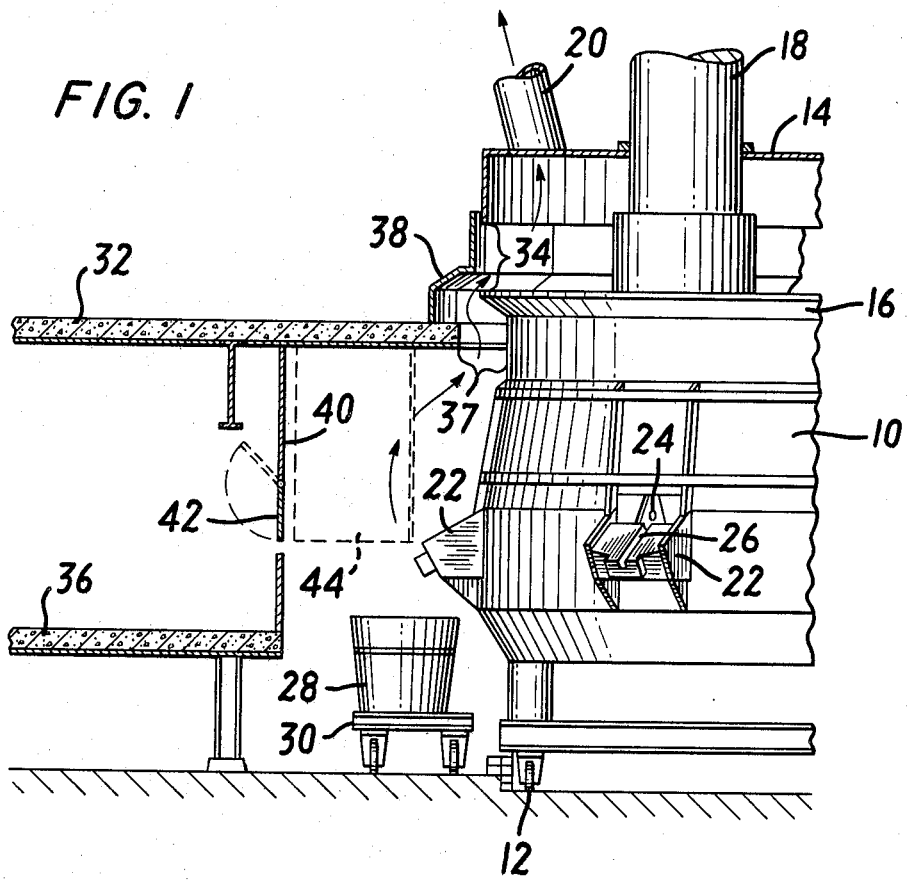
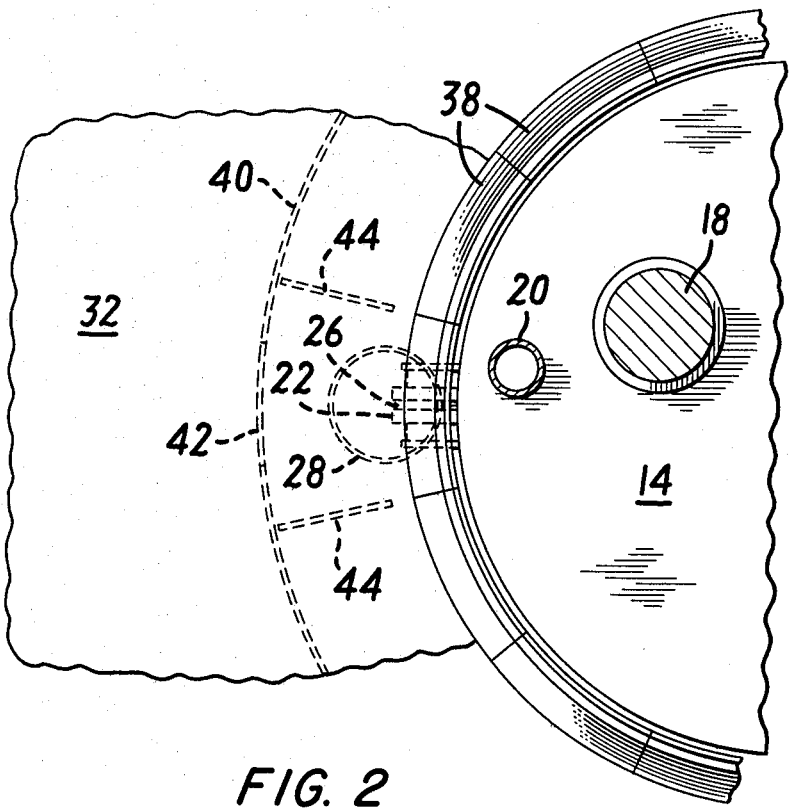
FIG. 2

APPARATUS FOR COLLECTION OF TAPPING GASES FROM ELECTRIC SMELTING FURNACES

The present invention relates to open electric smelting furnaces and in particular to the collection of tapping gases therefrom.

Because of polution problems and worker environment problems, most electric smelting furnaces are equipped with a smoke hood to remove gases generated during the smelting process. The smoke hood is usually disposed above the furnace with a substantial gap formed between the lower rim of the smoke hood and the furnace rim of the pot itself. The gap is provided for the purpose of permitting access to the furnace pot and also to provide a draft to the smoke hood. Because of these various functions which the gap between the hood and the top of the furnace pot serves, it is not practical to lower the hood all the way to the furnace rim.

While the smoke hood will collect most furnace gases, there are gases which are associated with tapping of molten metal from the furnace pot which are not trapped and tend to be quite a nuisance. These gases enter not only the tapping platform but also the furnace floor above. Heretofore, removal of these gases has required a separate ventilating apparatus associated with each tapping platform, but this is quite an expensive solution.

The applicants have now discovered that the gases from the tapping area can be effectively removed by means of the already available smoke hood by providing a greater than usual gap between the floor of the furnace and the furnace pot and then positioning a plurality of moveable screens to block off the gap between the smoke hood and the top of the furnace pot, at least in the area of tapping. Gases will thus pass through the gap between the furnace floor and the edge of the furnace pot and will be directed to pass upwardly through the smoke hood. In order to ensure that a proper draft can still be maintained in the smoke hood despite the screens and in order to provide access to the furnace pot, it is essential that the screens be made in a plurality of sections which are moveable with respect to each other. The sections may be moveable by sliding longitudinally or vertically or they may simply be individual sections which can be removed. In addition, auxiliary screens may be employed for sealing off the tapping platform. These auxiliary screens have the dual function of increasing the efficiency of tapping gas removal and protecting workers on the tapping platform.

These and other advantages of the present invention may be more fully understood with reference to the drawings in which:

FIG. 1 is a side view of a smelting furnace having a rotating furnace pot and including the apparatus of the present invention;

FIG. 2 is a top view of FIG. 1.

In FIG. 1 there is a furnace body 10 which is rotatable on wheels 12 which travel on a circular track. A smoke hood 14 is positioned above the top 16 of the furnace pot and has electrodes 18 protruding therethrough. A gas pipe 20 is connected to the smoke hood for the exhaustion of furnace gases. More than one such gas pipe may be supplied if desired. The side wall of the furnace pot 10 is provided with a tapping spout 22. Molten metal flows from tapping hole 24 through channel 26 of the tapping spout 22 into a tapping ladle 28. The tapping ladle 28 rests on a rail truck 30.

During normal furnace operations, workers are usually present on the furnace floor 32 and must have access to the furnace pot 10. For this purpose, and also for the purpose of draft as hereinbefore discussed, a gap 34 is left between the bottom of the smoke hood 14 and the top 16 of the furnace pot 10.

During tapping operations there are also present workers on the tapping floor 36. During tapping of molten metal from the furnace pot 10 into the tapping ladle 28, there will be an associated escape of gases from the tapping hole 24. These gases are quite a nuisance to both the workers on the furnace floor 32 and on the tapping floor 36.

In accordance with the present invention, the tapping gases are removed through the smoke hood by the combination of a relatively large gap 37 between the furnace floor 32 and the top of the furnace pot 10 and a plurality of screens 38 positioned about the top of the furnace pot at least in the area of tapping. These screens are arcuate (see especially FIG. 2), rest on the furnace floor and extend to a height at least equal to the bottom of the smoke hood.

Because of the rotation of the furnace pot there is always provided a small gap between the furnace floor 32 and the pot 10. However, to minimize escape of tapping gases onto the furnace floor and to prevent debris from falling from the furnace floor into the tapping area, this gap is usually made as small as practical. In accordance with the present invention the gap is made substantially larger.

The plurality of screens are preferably made separate so that they can be pushed or lifted away from the edge of the furnace pot. As previously discussed, it is essential that the screens be moveable with respect to each other so that access can be had to the top of the furnace pot and at the same time maintaining a proper draft. It is also highly desirable to make the individual screens of sufficient arcuate length that they are self supporting and do not need auxiliary means of support.

While in most cases the screens 38 will be sufficient in and of themselves to draw away the tapping gases, it being appreciated that when the screens are in place there will be a substantial upward draft between the furnace floor 32 and the smelting pot 10 which will tend to carry the tapping gases upward, there can also be provided screens 40 which will aid in providing a proper draft for removal of the tapping gases and will also protect workers on the tapping platform from the gases. These screens may be asbestos cloth or similar which is hung from the furnace floor or they may be walls such as of steel. The advantage to asbestos cloth or similar is that it can be relatively easily moved aside for access to the tapping area while a steel wall must have a hatch such as 42 for access to the tapping area. The auxiliary screens 40 form an enclosed volume which helps to channel the tapping gases into the smoke hood as shown by the arrows in the drawing. If tapping is normally carried out only in one sector of the rotation of the furnace pot, additional screens 44 may be hung from the underside of the furnace floor which will result in a substantially complete enclosing of the tapping area. These screens preferably extend from the furnace floor 32 to a point above the highest point of the tapping spout 22 so that they do not interfere therewith.

While the invention has been described hereinbefore with respect to a rotating furnace pot, it will be understood that the invention has equal applicability to stationary furnace pots. The same problems involving tapping gases exists in stationary pots as well as in rotating pots and the present invention can be used in stationary pots to remove tapping gases.

It will be understood that the claims are intended to cover all changes and modifications of the preferred embodiment of the invention, herein chosen for the purpose of illustration, which do not constitute departure from the spirit and scope of the invention. What is claimed is:

1. In an electric smelting furnace having a furnace pot, a furnace floor, a smoke hood positioned atop the furnace pot and the bottom of the smoke hood being spaced from the top of the furnace pot, a tapping spout in the side wall of the furnace pot below the furnace floor and a tapping hole through which molten metal is removed and tapping gases escape, the improvement comprising means for removing said tapping gases through said smoke hood without the need for auxiliary ventilation apparatus, said means comprising a substantial gap between the side wall of the furnace pot and the edge of the furnace floor and a plurality of arcuate screen-like members moveable with respect to each other, said screen-like members extending from the furnace floor to the bottom of the smoke hood whereby tapping gases tend to be drawn through said gap between the furnace pot and the furnace floor and up into the smoke hood and wherein said plurality of screens are present at least in the area of tapping and wherein said plurality of screens are moveable with respect to each other, each of said plurality of screens being a separate piece resting on the furnace floor of sufficient arcuate length to be free standing, and said screens being adapted to abutment end to end to form a continuous screen enclosure about a substantial portion of the furnace pot along its circumference.

2. The apparatus of claim 1 wherein auxiliary screens are provided to enhance the removal of tapping gases, said auxiliary screens being substantially parallel to the side wall of the furnace pot and extending from substantially the underside of the furnace floor to a point at least about as low as the tapping spout.

3. The apparatus of claim 2 wherein said auxiliary screens are metal.

4. In an electric smelting furnace having a furnace pot, a furnace floor, a smoke hood positioned atop the furnace pot and the bottom of the smoke hood being spaced from the top of the furnace pot, a tapping spout in the side wall of the furnace pot below the furnace floor and a tapping hole through which molten metal is removed and tapping gases escape, the improvement comprising means for removing said tapping gases through said smoke hood without the need for auxiliary ventilation apparatus, said means comprising a substantial gap between the side wall of the furnace pot and the edge of the furnace floor and a plurality of screen-like members moveable with respect to each other, said screen-like members extending from the furnace floor to the bottom of the smoke hood whereby tapping gases tend to be drawn through said gap between the furnace pot and the furnace floor and up into the smoke hood and wherein said plurality of screens are present at least in the area of tapping and wherein said plurality of screens are moveable with respect to each other, auxiliary screens are provided to enhance the removal of tapping gases, said auxiliary screens being substantially parallel to the side wall of the furnace pot and extending from substantially the underside of the furnace floor to a point at least about as low as the tapping spout, secondary auxiliary screens, said secondary auxiliary screens extending from about said auxiliary screens to about the side wall of the furnace pot and said auxiliary screens having a length from about the underside of the furnace floor to a point just above the tapping spout.

5. The apparatus of claim 4 wherein said secondary auxiliary screens are comprised of asbestos cloth or other material of similar heat resistance.

* * * * *